US009789522B2

(12) United States Patent
Hoeffgen et al.

(10) Patent No.: US 9,789,522 B2
(45) Date of Patent: Oct. 17, 2017

(54) ROLLING MILL AND ROLLING METHOD

(71) Applicant: SMS group GmbH, Duesseldorf (DE)

(72) Inventors: Walter Hoeffgen, Korschenbroich (DE); Walter Kirchner, Juechen (DE); Norbert Theelen, Erkelenz (DE)

(73) Assignee: SMS group GmbH, Duesseldorf (DE)

( * ) Notice: Subject to any disclaimer, the term of this patent is extended or adjusted under 35 U.S.C. 154(b) by 57 days.

(21) Appl. No.: 14/177,430

(22) Filed: Feb. 11, 2014

(65) Prior Publication Data

US 2014/0223984 A1 Aug. 14, 2014

(30) Foreign Application Priority Data

Feb. 12, 2013 (DE) ..... 10 2013 002 268

(51) Int. Cl.
*B21B 17/02* (2006.01)
*B21B 25/00* (2006.01)
(Continued)

(52) U.S. Cl.
CPC ..... *B21B 17/02* (2013.01); *B21B 25/00* (2013.01); *B21B 17/04* (2013.01); *B21B 25/04* (2013.01)

(58) Field of Classification Search
CPC ..... B21B 17/00–17/12; B21B 19/00–19/12; B21B 19/16; B21B 23/00;
(Continued)

(56) References Cited

U.S. PATENT DOCUMENTS 401,145 A 4/1889 Flagler
2,264,455 A * 12/1941 Peck ..... B21B 23/00 72/235
(Continued)

FOREIGN PATENT DOCUMENTS

DE 828 838 B 1/1952
DE 10 2011 012 761 A1 5/2012
(Continued)

OTHER PUBLICATIONS

German Office Action dated Feb. 10, 2015 in German Application No. 10 2013 002 268.1 with English translation of the relevant parts.
(Continued)

*Primary Examiner* — Peter DungBa Vo
*Assistant Examiner* — Joshua D Anderson
(74) *Attorney, Agent, or Firm* — Collard & Roe, P.C.

(57) ABSTRACT

In order to improve the quality of pipe-like work pieces, a rolling mill has at least two successive consecutive rolling stages that have mandrel rods. A threading line for the mandrel rod of the second rolling stage can lie on an extraction line for the mandrel rod of the first rolling stage. The same advantage can be achieved in a rolling method for the production of pipe-like work pieces, comprising at least two successive consecutive rolling stages, wherein the two rolling stages perform the rolling with the use of mandrel rods. The work piece is brought from the mandrel rod of the first rolling stage onto the mandrel rod of the second rolling stage, without entirely emptying an interior of the work piece and/or without changing the direction of movement of the work piece or braking the work piece in the meantime and accelerating it once again.

6 Claims, 4 Drawing Sheets

(51) Int. Cl.
*B21B 17/04* (2006.01)
*B21B 25/04* (2006.01)

(58) Field of Classification Search
CPC ..... B21B 25/00–25/06; B21B 37/78; B21B 45/00; B21B 2045/0227; B21B 2045/026; B21C 1/24; B21C 1/32; B21C 1/34; B21C 3/16; B21C 45/00
USPC ..... 72/86, 91, 95–97, 208, 209, 226, 227, 72/236, 365.2, 366.2, 368, 370.01, 72/370.06, 370.14, 370.24, 370.25
See application file for complete search history.

(56) References Cited

U.S. PATENT DOCUMENTS 4,037,449 A * 7/1977 Schuetz ..... B21B 25/06 72/209
4,289,011 A * 9/1981 Yoshiwara ..... B21B 17/04 72/208
4,487,049 A * 12/1984 Danchenko ..... B21B 25/00 72/208
4,928,507 A * 5/1990 Staat ..... B21B 19/02 72/358
2010/0212387 A1 8/2010 Hoeffgen et al.

FOREIGN PATENT DOCUMENTS

| | | | |
|---|---|---|---|
| EP | 1 764 167 | A1 | 3/2007 |
| JP | S55156607 | A | 12/1980 |
| SU | 1022760 | A1 | 6/1983 |
| WO | 2010/025790 | A1 | 3/2010 |
| WO | 2012/120111 | A1 | 9/2012 |

OTHER PUBLICATIONS

English translation of the Russian Office Action dated Sep. 25, 2015 in Russian Application No. 2014102277/02.

* cited by examiner

ROLLING MILL AND ROLLING METHOD

CROSS REFERENCE TO RELATED APPLICATIONS

Applicant claims priority under 35 U.S.C. §119 of German Application No. 10 2013 002 268.1 filed Feb. 12, 2013, the disclosure of which is incorporated by reference.

BACKGROUND OF THE INVENTION

1. Field of the Invention

The invention relates to a rolling mill for the production of pipe-like work pieces, comprising at least two successive consecutive rolling stages that comprise mandrel rods. Likewise, the invention relates to a rolling method for the production of pipe-like work pieces, comprising at least two successive consecutive rolling stages that perform the rolling with the use of mandrel rods.

2. The Prior Art

Rolling mills and methods of this type are described in EP 1 764 167 A1, from WO 2012/120111 A1, and from WO 2010/025790 A1.

SUMMARY OF THE INVENTION

It is the object of the present invention to improve the quality of the pipe-like work pieces in such rolling mills or rolling methods.

As a solution, the present invention comprises a rolling mill for the production of pipe-like work pieces, comprising at least two successive consecutive rolling stages, in which the two rolling stages comprise mandrel rods. In the present invention, a threading line for the mandrel rod of the second rolling stage lies on an extraction line for the mandrel rod of the first rolling stage.

In the case of suitable method management and overall design of the mill, the time within which the mandrel rod of the first rolling stage is extracted and the mandrel rod of the second rolling stage is threaded in can be minimized. This leads to a more uniform temperature progression in the work piece, and therefore, accordingly, also to improved work piece quality.

Accordingly, it is advantageous if the work piece is brought from the mandrel rod of the first rolling stage onto the mandrel rod of the second rolling stage without entirely emptying an interior of the work piece, as it must naturally occur during rolling by means of a mandrel rod. This means that the amount of air that is withdrawn from the interior of the work piece while the mandrel rod of the first rolling stage is extracted is limited, and thereby scale formation can be minimized. This results in fewer interior defects in the work pieces, so that the work piece quality increases accordingly. Also, it is then possible to perform the mandrel rod change-over correspondingly quickly, so that the work piece quality can be raised.

Accordingly, it is also advantageous if the work piece is brought from the mandrel rod of the first rolling stage onto the mandrel rod of the second rolling stage, without changing the direction of movement of the work piece or braking the work piece in the meantime and accelerating it once again. This also leads to the result that the mandrel rod change-over can proceed relatively quickly, which is correspondingly advantageous for the work piece quality, because every acceleration process is ultimately time-consuming.

It is understood that the movement sequences described above describe relative movements between the work piece and the mandrel rods, so that corresponding movement sequences can be implemented accordingly also in the case of moving mandrel rods.

Preferably, the work piece is brought from the mandrel rod of the first rolling stage, while the mandrel rod of the first rolling stage is still situated in the work piece, onto the mandrel rod of the second rolling stage. This leads to correspondingly short time sequences and also to a minimal introduction of air during the mandrel rod change-over, and this accordingly has a positive influence on the work piece quality.

Likewise, an intermediate rod can provided between the two mandrel rods at least during a mandrel rod change-over, so that the work piece is brought from the mandrel rod of the first rolling stage, while the mandrel rod of the first rolling stage is still situated in the work piece, onto an intermediate rod and from the intermediate rod, while the intermediate rod is still situated in the work piece, onto the mandrel rod of the second rolling stage. Such an intermediate rod can be used, for example, as a spacer or to minimize a cavity. Likewise, it is possible to carry out measures on the work piece, such as lubrication processes or application of deoxidation agents, by way of the intermediate rod.

In this connection, it is understood that the distance between the rods, whether the mandrel rods or the distance between the intermediate rod and a mandrel rod, should be selected to be as small as possible, in order to reduce to a minimum the amount of air that can be drawn into the interior of the work piece during the rod change-over. Such a very small distance furthermore has the advantage that any rolling peels such as those that can occur during piercing, for example, are unlikely to be drawn into the interior of the work piece, so that in this regard, as well, the interior defects in the work piece can be minimized, and correspondingly improved work piece lifetimes can be implemented. These disadvantages can be reduced to a minimum if the rods touch during the change-over. Then, no room remains for possibly drawing in air or rolling peels in the interior of the work piece. On the other hand, it is understood that a minimal distance also does not lead to any noteworthy disadvantages.

During extraction or threading, opposite forces must be applied not only to the work piece but also to each of the mandrel rods. In this connection, it is advantageous if the rods put tensile or pressure stress on one another during the change-over, so that accordingly, the devices, such as a hold-back mechanism or possible stops, for example, can be used equally for both mandrel rods.

It is also advantageous if a longitudinal work piece transport that conveys the work piece from an extraction start position all the way to a threading end position is provided, because in this way, possible standing times that could be caused by the intervention of an additional work piece transport are minimized. In particular, it is possible for the extraction line for the mandrel rod of the first rolling stage and the threading line for the mandrel rod of the second rolling stage to lie on a rolling line of the second rolling stage. Aside from the advantages already mentioned initially, this brings about the result that the cool mandrel rod of the second rolling stage is disposed in the work piece for only a short time until this can be passed to the second rolling stage immediately after threading and without any further change in direction and the like. In this regard, this arrangement is particularly suitable for rolling of relatively thin-walled work pieces or hollow blocks in the second rolling stage.

Higher cycle times can be achieved if the extraction line for the mandrel rod of the first rolling stage and the threading line for the mandrel rod of the second rolling stage lie on a rolling line of the first rolling stage, because the work piece, once it has been accelerated and comes out of the first rolling stage, can then be directly freed from the first mandrel rod and passed over the second mandrel rod, under some circumstances, and this requires accordingly higher cycle times, or, particularly if the mandrel rod of the second rolling stage is relatively long, as is the case for mandrel rolling mills, for example, the threading process can already have been started when a work piece that passed through the rolling mill previously is still situated in the second rolling stage.

It is also advantageous if the first rolling stage comprises a run-up mandrel rod, such as a piercer rod, for example, because then, the piercing rod is provided on the run-out side of the first rolling stage, in any case. In this regard, it is particularly advantageous if the first rolling stage is a cross-roll piercing mill or piercing mill or method, respectively.

Preferably, the second rolling stage comprises a rotating mandrel rod, so that the advantages and characteristics mentioned above can be implemented in accordingly simple manner. In this regard, it is particularly advantageous if the second rolling stage is a mandrel rolling mill or method, respectively.

It is particularly advantageous if the two rolling stages follow one another without the interposition of a further forming stage, particularly without the interposition of a further rolling stage. On the other hand, of course, it is also easily possible to provide further rolling stages subsequently—if applicable also without the use of a mandrel rod or with the use of the same or also different mandrel rods. In particular, an extraction mill and/or a sizing mill can be provided.

Preferably, the interior of the work piece is provided with a deoxidation agent and/or lubricant before or during extraction of the mandrel rod of the first rolling stage. In this way, a further method step, which ultimately costs a lot of time, is eliminated. For example, provision of a deoxidation agent and/or lubricant during extraction can take place in that an intermediate rod having a corresponding deoxidation agent and/or lubricant feed is disposed behind the mandrel rod of the first rolling stage. Likewise, corresponding deoxidation agents and/or lubricants can be brought into the interior of the work piece by way of the mandrel rod itself. This can take place during extraction, on the one hand, if the lubricant is supplied to the mandrel rod by way of a hold-back mechanism, for example. Likewise, this can also already take place by way of known mandrel rods or piercers, for example, while the work piece is still being rolled over the mandrel rod of the first rolling stage, so that it is accordingly advantageous if the mandrel rod of the first rolling stage comprises a deoxidation agent and/or lubricant feed.

It is understood that the characteristics of the solutions described above and in the claims can also be combined, if necessary, in order to be able to implement the advantages cumulatively, accordingly.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
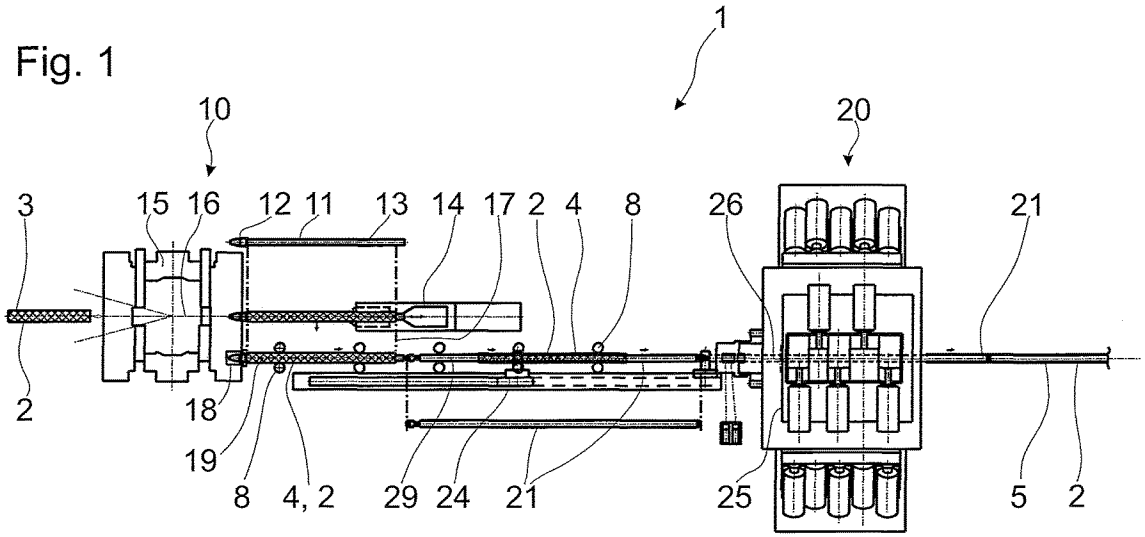
FIG. 1 shows a schematic top view of a first rolling mill.

Referring now in detail to the drawings, the rolling mill 1 shown in FIG. 1 rolls a work piece 2, proceeding from a block, in a first rolling stage 10 that is configured as a cross-roll piercing mill 15, first into a hollow block 4 and then, in a second rolling stage 20, which is configured as a mandrel rolling mill 25, to produce a shell 5.

Both the first rolling stage 10 and the second rolling stage 20 have mandrel rods 11, 21. The mandrel rod 11 of the first rolling stage 10 comprises a piercer 12 and a rod 13, which is held by way of a counter-bearing 14 as a run-up mandrel rod 11, counter to the direction of movement of the work piece 2 through the first rolling stage 10.

The work piece 2 or the hollow block 4, respectively, after being rolled in the first rolling stage 10, is brought, by way of a transverse transport 17 that is not shown in any detail and is sufficiently known, from a rolling line 16 of the first rolling stage 10 onto an extraction line 19, on which the mandrel rod 11 of the first rolling stage 10 is extracted from the hollow block 4 by means of a hold-back mechanism 18 and a longitudinal work piece transport 8, in that the hollow block 4 is moved along the extraction line 19. Also, the extraction line 19 lies directly on a threading line 29 of the second rolling stage, so that the longitudinal work piece transport 8 can move the work piece 2 from an extraction start position all the way to a threading end position on the second mandrel rod 21, without changing the direction of movement of the work piece 2 or braking the work piece in the meantime and accelerating it again. In this connection, the threading line 29 lies directly on the rolling line 26 of the second rolling stage 20, so that after threading of the mandrel rod 21 of the second rolling stage 20, a retainer 24 merely needs to grasp the mandrel rod 21 with the second rolling stage and to guide it through the mandrel rolling mill 25 in known manner.

As is directly evident, the cold mandrel rod 21 of the second rolling stage 20 remains within the hollow block 4 for only a relatively short time, until this block is processed in the mandrel rolling mill 25, so that cooling, which ultimately could impair the quality of the work piece 2, is avoided.

Furthermore, the entire method sequence is extremely time-saving, so that for this reason, as well, cooling of the work piece 2 between the two rolling stages 10, 20 is reduced to a minimum.

Depending on the concrete implementation of this exemplary embodiment, the mandrel rods 11 and 21 can be connected with one another by tension, so that the hold-back mechanism 18, in particular, can also hold back the mandrel rod 21 of the second rolling stage 20, counter to the movement of the hollow block 4, during the mandrel rod change-over. Preferably, there is a particularly small distance between the two mandrel rods 11, 21, so that for one thing, as little air as possible is drawn into the interior of the hollow block 4, and for another, the risk that rolling peels get into the interior of the hollow block 4 is reduced to a minimum.

In an alternative embodiment, the mandrel rod 21 of the second rolling stage 20 is supported in the region of the rolls of the mandrel rolling mill 25—and, if necessary, actually helps to support the mandrel rod 11 of the first rolling stage 10, if both of them interact end to end, with or without an intermediate rod.

Figure 2:
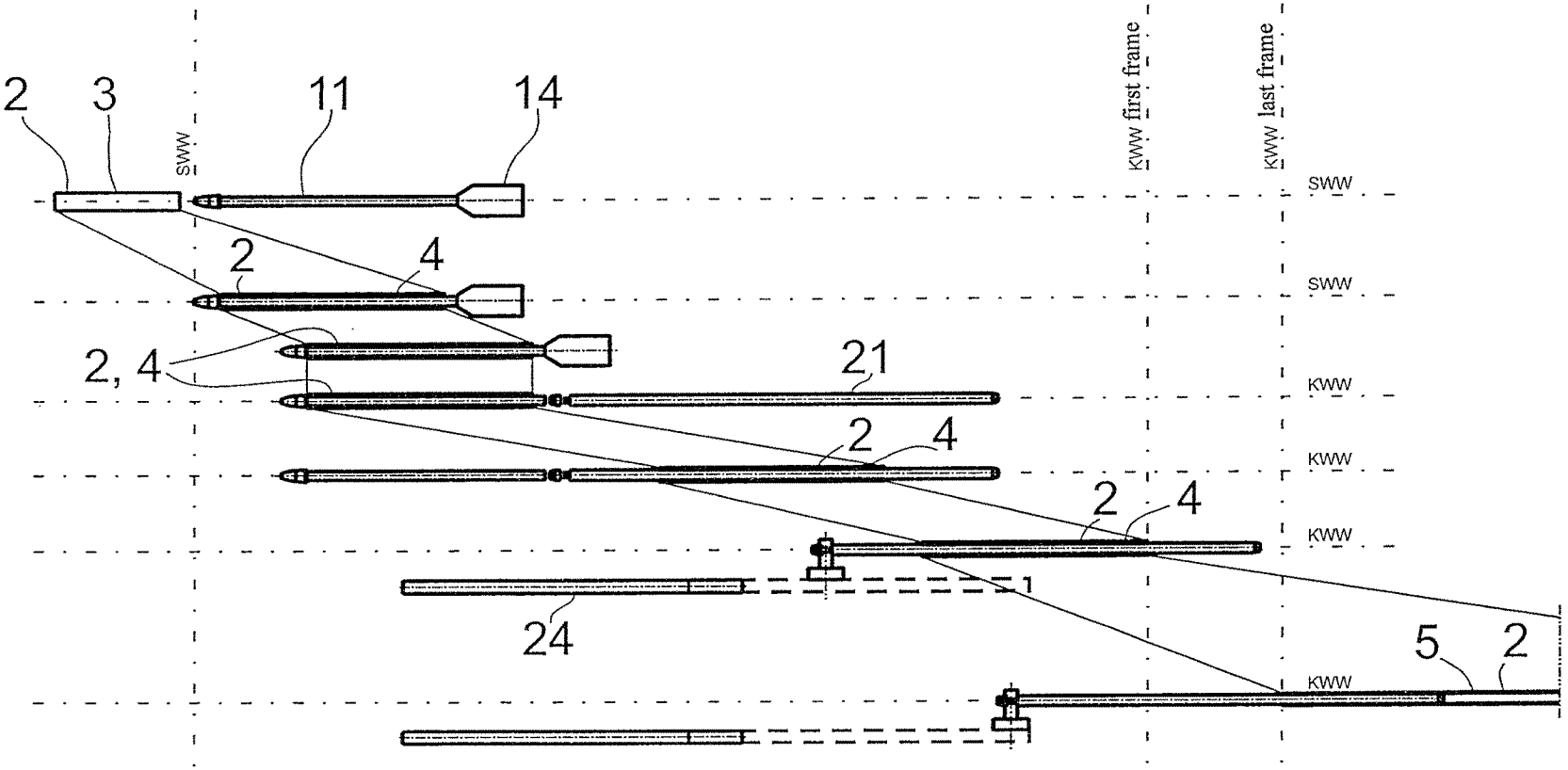
FIG. 2 shows the schematic method sequence of a rolling method carried out on the rolling mill according to FIG. 1.

The method sequence described above, as such, is shown in detail in FIG. 2.

Figure 3:
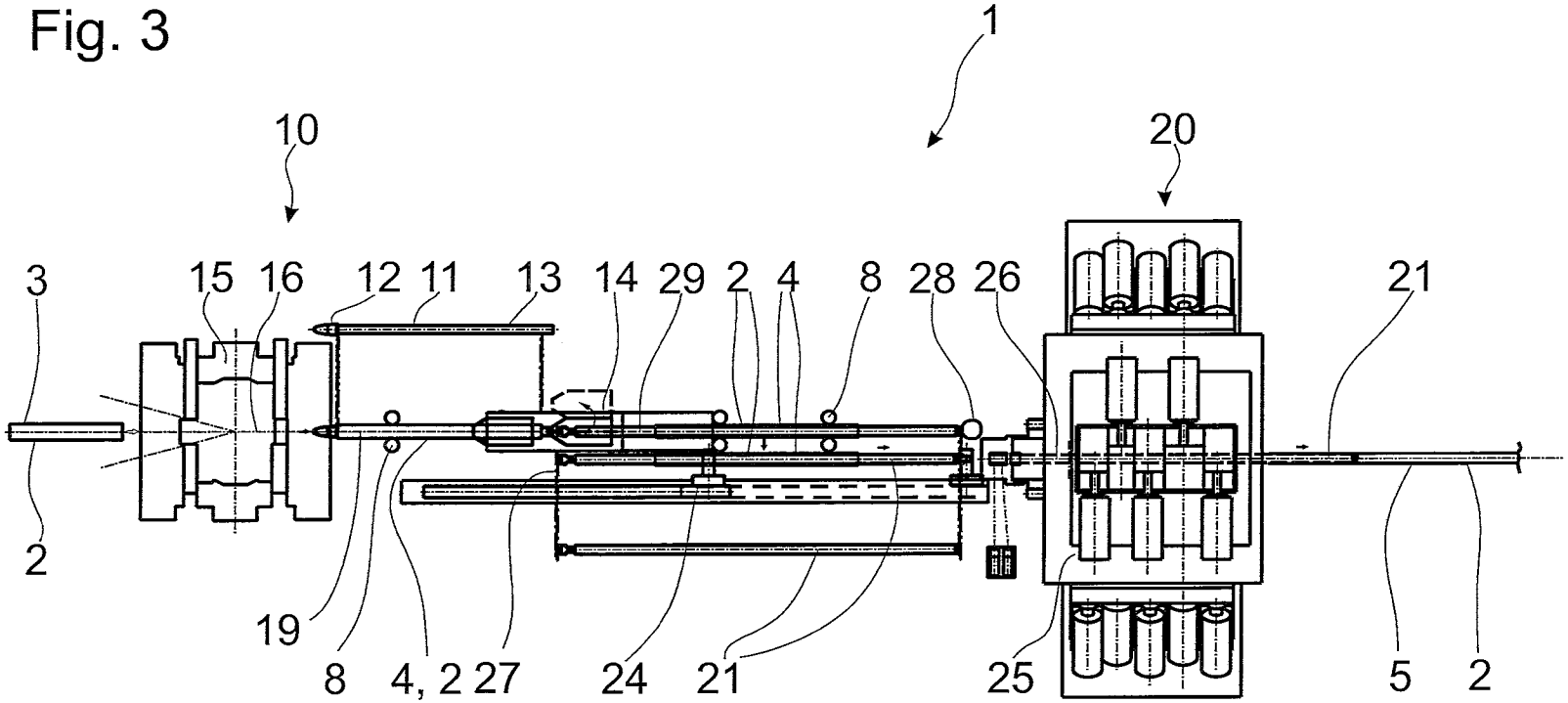
FIG. 3 shows a schematic top view of a second rolling mill.
Figure 4:
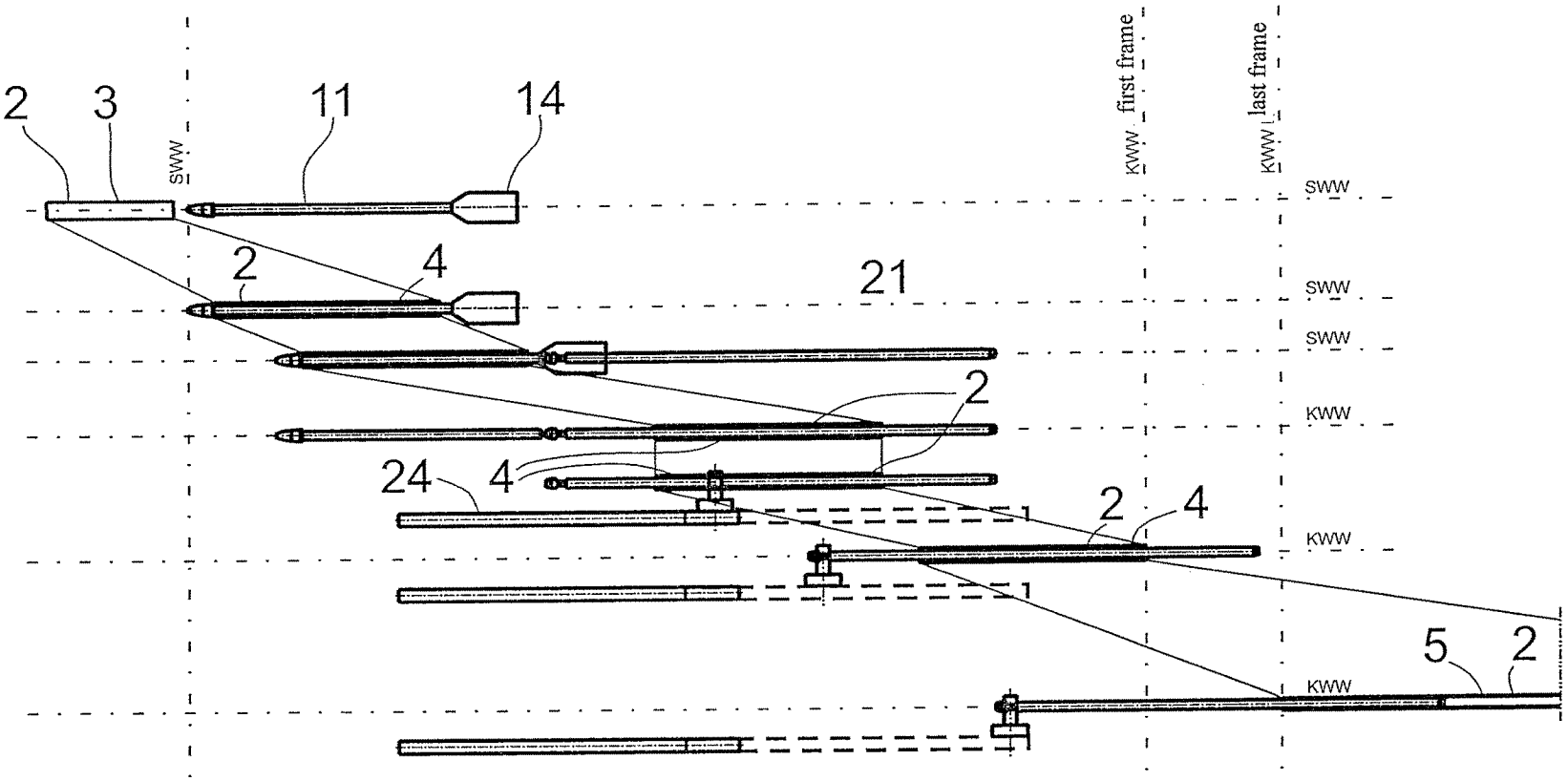
FIG. 4 shows the schematic method sequence of a rolling method carried out on the rolling mill according to FIG. 3.

The threading line 29 of the second rolling stage lies on the extraction line 19 of the first rolling stage 10 also in the arrangement according to FIGS. 3 and 4. However, in this embodiment, the two lines 19, 29 lie on the rolling line 16 of the first rolling stage, so that the hollow block 4 can be released from the mandrel rod 11 of the first rolling stage 10 directly after rolling, from the end position, by means of the longitudinal work piece transport 8, and can be brought over the mandrel rod 21 of the second rolling stage 20. In order to counter the forces that occur in this connection, this arrangement has a counter-bearing 28 that supports both the mandrel rod 21 of the second rolling stage 20 and the mandrel rod 11 of the first rolling stage 10, whereby the counter-bearing 14 of the first rolling stage 10 is still pivoted away before threading, and the two mandrel rods 11, 21 are brought end to end with one another.

After threading of the mandrel rod 21 of the second rolling stage 20, the hollow block 4, together with the threaded mandrel rod 21, is transferred to the rolling line 26 of the second rolling stage 20 by means of the transverse transport 27, in order to then be rolled in known manner.

Here, too, FIG. 4 shows the method sequence schematically.

The arrangement shown in FIGS. 3 and 4 can be operated at higher cycle times, because in view of the length of the mandrel rod 21 of the second rolling stage 20, a work piece 2 that has previously passed through the rolling mill 1 can still be rolled in the second rolling stage 20 while the work piece 2 is already being threaded onto the mandrel rod 21.

It is understood that if necessary, a transfer of the work piece 2 from the one mandrel rod 11 to the other mandrel rod 21 can also take place in intermediate positions between the rolling line 16 of the first rolling stage and the rolling line 26 of the second rolling stage. This is particularly possible during a transport, in which not only the mandrel rods 11, 21 but also the work piece 2 are being moved.

In both embodiments, the mandrel rod 11 of the first rolling stage 10 is configured in such a manner that it can bring deoxidation agents or lubricants into the interior of the hollow block 4. In this manner, scale formation can be prevented to an even greater extent. Furthermore, it is possible to eliminate a further intermediate step for lubrication, if applicable. It is understood that a corresponding apparatus for application of the deoxidation agent or lubricant can also be provided at a different location, for example on an intermediate rod.

Accordingly, while only a few embodiments of the present invention have been shown and described, it is obvious that many changes and modifications may be made thereunto without departing from the spirit and scope of the invention.

REFERENCE SYMBOL LIST

1 rolling mill
2 work piece
3 block
4 hollow block
5 shell
6 longitudinal work piece transport
10 first rolling stage
11 mandrel rod
12 piercer
13 rod
14 counter-bearing
15 cross-roll piercing mill
16 rolling line of the first rolling stage
17 transverse transport
18 hold-back mechanism
19 extraction line
20 second rolling stage
21 mandrel rod
24 retainer
25 mandrel rolling mill
26 rolling line of the second rolling stage
27 transverse transport
28 counter-bearing
29 threading line

What is claimed is:

1. A rolling method for the production of a pipe-like work piece, using at least two successive consecutive rolling stages, wherein the two rolling stages perform the rolling with a mandrel rod in the first rolling stage and another mandrel rod in the second rolling stage, the method comprising:

rolling a work piece in the first rolling stage being a cross-roll piercing method using the mandrel rod of the first rolling stage in order to form the work piece from a block into a hollow block with the mandrel rod of the first stage located in an interior of the work piece;

bringing the work piece from the mandrel rod of the first rolling stage onto the mandrel rod of the second rolling stage by inserting the mandrel rod of the second rolling stage into the interior of the work piece without entirely removing the mandrel rod of the first rolling stage from the interior of the work piece and without changing a direction of movement of the work piece and without braking the work piece and accelerating the work piece once again, wherein the mandrel rod of the second rolling stage moves with the work piece during the second rolling stage, and wherein the second rolling stage is a mandrel rolling method.

2. The rolling method according to claim 1, wherein the work piece is brought from the mandrel rod of the first rolling stage, while the mandrel rod of the first rolling stage is still situated in the work piece, onto the mandrel rod of the second rolling stage, and/or wherein the work piece is brought from the mandrel rod of the first rolling stage, while the mandrel rod of the first rolling stage is still situated in the work piece, onto an intermediate rod and from the intermediate rod, while the intermediate rod is still situated in the work piece, onto the mandrel rod of the second rolling stage.

3. The rolling method according to claim 1, wherein the mandrel rods touch during the step of bringing the work piece from the first rolling stage to the second rolling stage.

4. The rolling method according to claim 1, wherein the rods put tensile or pressure stress on one another during the step of bringing the work piece from the first rolling stage to the second rolling stage.

5. The rolling method according to claim 1, wherein an interior of the work piece is provided with a deoxidation agent and/or lubricant during extraction of the mandrel rod of the first rolling stage.

6. The rolling method according claim 1, wherein the two rolling stages follow one another without interposition of a further forming stage.

* * * * *